United States Patent [19]

Corey

[11] 4,406,725

[45] Sep. 27, 1983

[54] FASTENER BONDING MACHINE

[75] Inventor: Joseph T. Corey, Eggertsville, N.Y.

[73] Assignee: Permclip Products Corporation, Buffalo, N.Y.

[21] Appl. No.: 204,462

[22] Filed: Nov. 6, 1980

[51] Int. Cl.[3] ..... B30B 15/06; B30B 15/34

[52] U.S. Cl. ..... 156/358; 156/366; 156/368; 156/583.1; 156/583.2; 156/583.9; 219/243

[58] Field of Search ..... 156/358, 366, 368, 583.1, 156/583.2, 583.8, 583.9, 274.4, 580, 379.8, 380.2, 380.4, 380.6, 380.7, 380.8; 100/93 P; 219/243, 257

[56] References Cited

U.S. PATENT DOCUMENTS

| | | | |
|---|---|---|---|
| 3,106,630 | 10/1963 | Klamp | 156/583.9 |
| 3,375,777 | 4/1968 | Techtmann et al. | 156/583.8 |
| 3,472,721 | 10/1969 | Abramson et al. | 156/580 |
| 3,657,055 | 4/1972 | Nichols | 156/583.1 |
| 3,692,611 | 9/1972 | Kuhnle | 156/583.9 |
| 4,058,055 | 11/1977 | Douglas | 156/583.9 |
| 4,167,435 | 9/1979 | Olschewski | 156/583.1 |
| 4,229,244 | 10/1980 | Swope | 156/583.9 |

*Primary Examiner*—Michael G. Wityshyn
*Attorney, Agent, or Firm*—Joseph P. Gastel

[57] ABSTRACT

A fastener bonding machine for bonding a fastener to a leaf of a file folder, the fastener consisting of an overlay member having hot melt adhesive on one side thereof and having a pronged member mounted thereon, the bonding machine including a base, a heated platen on the base, a first gauge for locating the fastener relative to the heated platen, a pivotal plate mounted on the base, a second gauge for locating the leaf of a file folder relative to the fastener, a proximity switch actuatable by movement of the pivotable plate, a motor, a toggle linkage actuatable by the motor, a presser member movable by the toggle linkage to press the leaf and the fastener together, and a control circuit for causing the presser member to dwell for a period of time during the pressing action and to thereafter return the toggle linkage to a position wherein the presser member has moved away from the platen.

20 Claims, 12 Drawing Figures

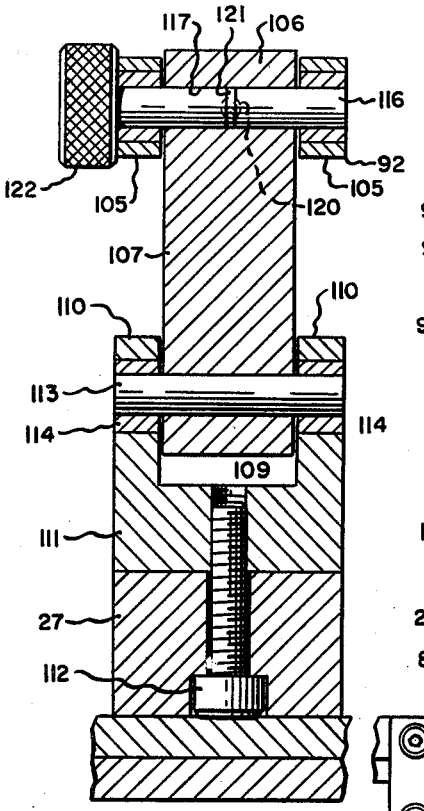
Fig. 7.
Fig. 8.
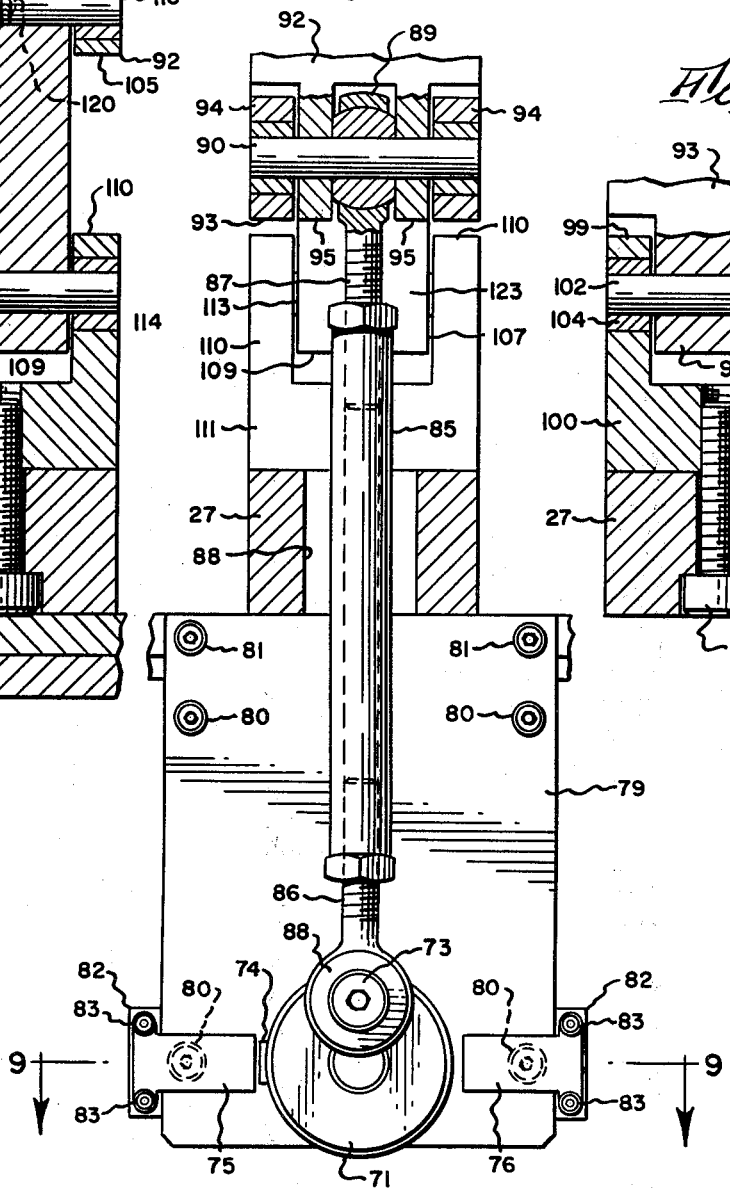
Fig. 10.
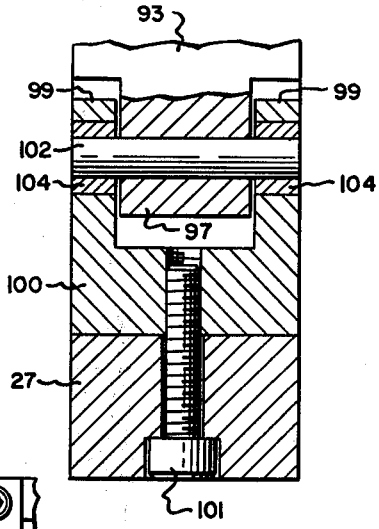
Fig. 9.
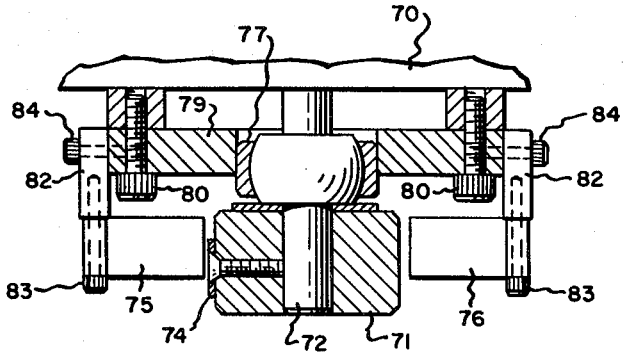

FASTENER BONDING MACHINE

BACKGROUND OF THE INVENTION

The present invention relates to a machine for bonding a pronged fastener to the leaf of a file folder.

By way of background, there are in use file folders having pronged fasteners adhesively secured thereto. An example of this type of arrangement is shown in U.S. Pat. No. 3,867,743. In the past, rather complicated machinery was required for bonding a pronged fastener to the leaf of a file folder. This machinery was capable of producing a high volume output and was sufficiently expensive so that it was economically unfeasible for small stationers to purchase machines of this type. Structurally, this prior type of machine operated by the use of cams which caused a presser member to press a folder against a heated platen.

SUMMARY OF THE INVENTION

It is accordingly one object of the present invention to provide an improved fastener bonding machine which is of relatively simple and inexpensive construction and which can therefore be purchased by small stationers who do not have large volume requirements for folders with bonded fasteners.

Another object of the present invention is to provide a fastener bonding machine which is extremely simple in construction and extremely simple to operate and which includes a plurality of safety guards for preventing accidents.

A further object of the present invention is to provide a fastener bonding machine which can be disassembled very simply from its base so that access can be had to the entire machine for maintenance or repairs.

Yet another object of the present invention is to provide an improved fastener bonding machine which can provide extremely high pressure for producing a bond between a fastener and the leaf of a folder even though it is structurally very simple. Other objects and attendant advantages of the present invention will readily be perceived hereafter.

The fastener bonding machine of the present invention comprises a base, gauge means on said base for locating a fastener having a pronged member and an overlay member with adhesive thereon, leaf-receiving means on said base for receiving a leaf to which said fastener is to be bonded with said leaf being oriented in overlying relationship to said fastener, a heated platen on said base oriented to receive said overlay member in contiguous relationship, a presser member for pressing said leaf toward said heated platen with said fastener therebetween, a motor, a toggle linkage between said motor and said presser member, and means for energizing said motor to move said toggle linkage from a relatively nonaligned position to a relatively aligned position to cause said presser member to approach said heated platen to press said leaf and fastener together while said fastener is being heated by said platen and to thereafter cause said toggle linkage to return to a relatively nonaligned position to permit removal of said leaf after said fastener has been adhesively secured thereto. The present invention will be more fully understood when the following portions of the specification are read in conjunction with the accompanying drawings wherein:

BRIEF DESCRIPTION OF THE DRAWINGS

FIG. 7 is a fragmentary cross sectional view taken substantially along line 7—7 of FIG. 3 and showing the removable pin for connecting the toggle linkage to the presser member and also showing the pivotal connection between the presser member and the base;

FIG. 8 is a fragmentary cross sectional view taken substantially along line 8—8 of FIG. 3 and showing the relationship between the drive motor and the toggle linkage;

FIG. 9 is a fragmentary cross sectional view taken substantially along line 9—9 of FIG. 8 and showing the details of the motor drive and the proximity switches associated therewith;

FIG. 10 is a fragmentary cross sectional view taken substantially along line 10—10 of FIG. 3 and showing the pivotal connection between the toggle linkage and the base.

DESCRIPTION OF THE PREFERRED EMBODIMENT

Figure 1A:
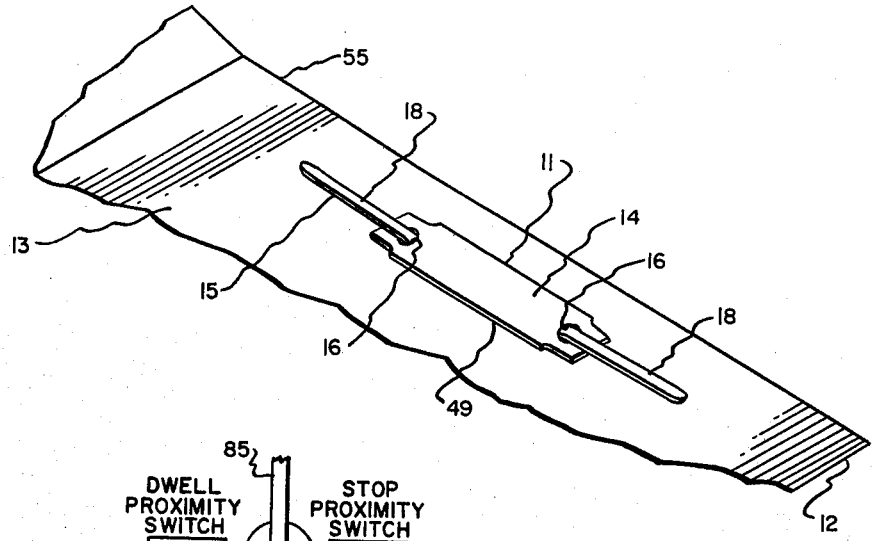
FIG. 1A is a fragmentary perspective view showing a leaf of a folder with a fastener bonded thereon.

The fastener bonding machine 10 of the present invention is for attaching a fastener 11 (FIG. 1A) to the leaf 12 of a file folder 13 or the like. Insofar as pertinent here, fastener 11 includes an overlay member 14 of flexible planar material, such as Kraft paper, and a prong member 15 which extends through spaced holes 16 in the overlay member with the central portion of the prong member 15 being located between overlay member 14 and the leaf 12. Hot melt adhesive is on the side of overlay member 14 facing leaf 12, and the fastener 11 is attached to leaf 12 by the application of suitable heat and pressure, as described in greater detail hereafter. The overlay member 11 may be substantially identical in construction to that described and shown in U.S. Pat. No. 3,867,743.

The fastener bonding machine 10 includes a table top 17 mounted on legs 19. Secured to legs 19 are beam-like members 20 which extend between legs 19. Angle brackets 21 (FIGS. 2 and 3) have vertical legs 28 secured to beams 20 and they have horizontal legs 22 on which table top 17 is supported, as well as being supported by the upper surfaces of beams 20 and the upper ends of legs 19. Suitable fastener devices, such as screw members 23, secure table top 17 to angles 21.

The actual working parts 26 of the machine are removably secured to the table, and the upper portions of working parts 26 extend through openings 24 and 25 in table top 17. The working parts 26 include a base beam 27 (FIG. 3) having opposite ends which rest on horizontal legs 29 of angles 30 having vertical legs 31 which are secured to beams 20 by means of screws 32. Screws 33 are located in aligned holes 34 and 35 in beam 27 and angles 30, respectively, to maintain beam 27 in position. As will become apparent hereafter, by withdrawing screws 33 from holes 35 after table top 17 has been removed, the entire assembly of working parts 26 may be lifted off of the remainder of the machine.

Figure 5:
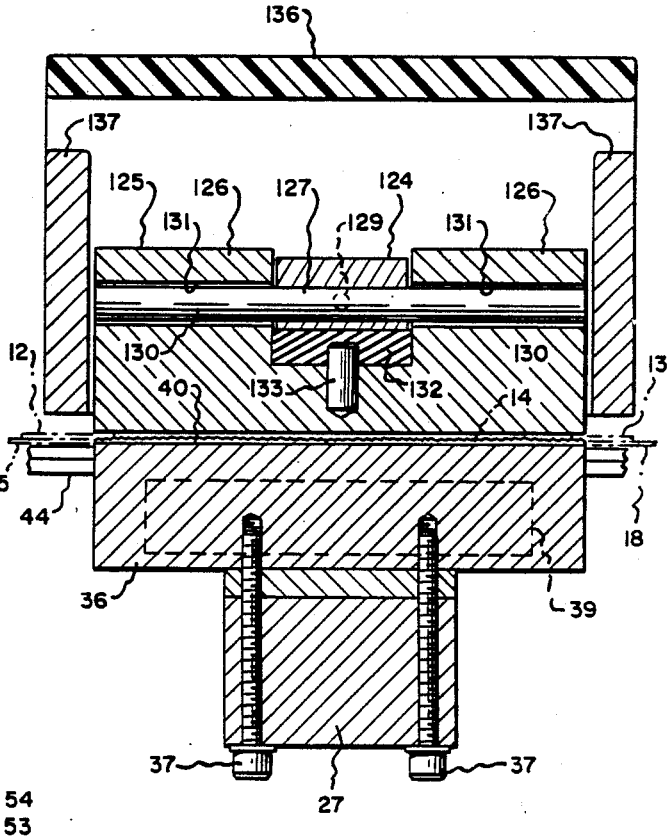
FIG. 5 is a fragmentary cross sectional view taken substantially along line 5—5 of FIG. 3 and showing the relationship between the presser member and the platen.

The first step in the procedure for bonding fastener 11 to leaf 12 is to insert fastener 11 into the machine. In this respect, a heated platen 36 (FIGS. 3 and 5) is secured to beam 27 by means of screws 37. A suitable resistance heating element 39 is located in platen 36 and current is supplied through leads 39' when the machine is switched on. The top of platen 36 has a shallow slot 40 therein to receive the portions of prong member 15 which lie on platen 36. The end portions 18 of prong member 15 are also received in slots 41 of alignment gauges 42 which are secured by screws 43 to supporting plate 44. In addition, a gauge member 45, which includes a vertical surface 46 and a horizontal leg 48, is adjustably secured to plate 44 by screws 47. By adjusting the lateral position of vertical surface 46, and bringing the end of prong 18 into contact with surface 46, the position of overlay member 14 on platen 36 can be adjusted. Magnets 38 on platen 38 hold the overlay member in its proper position. The fastener member 11 is thus located on platen 36 with the surface 49 thereof which contains hot melt adhesive facing upwardly.

The next step in the procedure of bonding fastener 11 to leaf 12 is to locate leaf 12 in the machine. To this end, a pair of movable side guides or gauges 50 and 51 are provided on table 17. These guides can be secured in any desired position. Mounted on the machine is an end guide 52. This end guide can be adjusted to a desired position by virtue of the slots 54 in the ends thereof which receive screws 53 which are anchored on plate 44. The upper edge 55 of the folder (FIG. 1A) is brought into abutting relationship with edge 56 of gauge 52 while the side of leaf 12 is maintained in engagement with one of guides 50 or 51. Thus, the leaf 12 is positively located relative to fastener 11 and thereafter the bonding is effected by applying heat and pressure to leaf 12 and fastener 11 while they are positioned in contiguous relationship.

Figure 6:
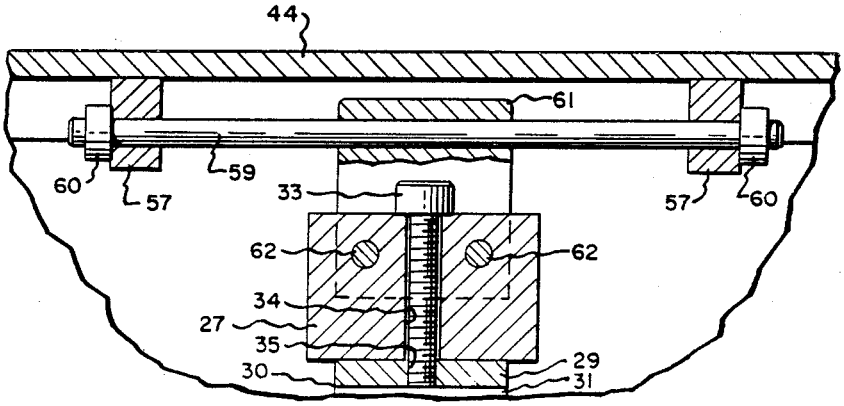
FIG. 6 is a fragmentary cross sectional view taken substantially along line 6—6 of FIG. 3 and showing the pivotal mounting for the folder-supporting plate.

When the leaf 12 is in position on the machine, it lies on the upper surface of pivotable plate 44 which is pressed downwardly to initiate the bonding action. In this respect, plate 44 includes a pair of spaced lugs 57 (FIGS. 3 and 6) which are attached to and extend downwardly from the underside of plate 44 and which receive rod 59 which is secured in position by collars 60. Rod 59 is pivotally mounted in block 61 which is secured to beam 27 by means of screws 62. Plate 44 is biased in a counterclockwise direction in FIG. 3 about shaft 59 by spring 63 which is interposed between the upper surface of beam 27 and the underside of plate 44. When plate 44 is pivoted in a clockwise direction, it will approach proximity switch 64 which is secured to beam 27 by means of bracket 65. Proximity switch 64 is vertically adjustable by means of the screws 66 which cooperate with slots 67. The energization of proximity switch 64 by pivoting plate 44 downwardly will actuate the electric circuit, which is described in greater detail hereafter, to start electric motor 69 which is attached to gear reducer 70 which in turn is suitably secured to the undersurface of beam 27. The actuation of gear reducer 70 will cause crank 71, which is mounted on the output shaft 72 of gear reducer 70, to rotate from a position wherein the crank pin 73 is in a bottom dead center position to a position where it is in the top dead center position shown in FIG. 3. At this time motor 69 will be caused to dwell for a predetermined time interval, and at this time pressure will be applied to the leaf and the fastener member. At the time that the crank pin 73 is in top dead center, the metal lug 74 will be adjacent proximity switch 75 which will actuate the electric circuit to cause the dwell to take place. After the dwell has been completed, the crank will move to a position 180° removed from the position shown in FIG. 8 where lug 74 will be adjacent proximity switch 76 which in turn will terminate the operation of electric motor 69 with crank pin 73 in a bottom dead center position. Output shaft 72 is supported in spherical bearing 77 (FIG. 9) mounted in plate 79 which is secured relative to gear reducer 70 by means of screws 80 and 81. Proximity switches 75 and 76 are secured to brackets 82 by means of screws 83, and brackets 82 in turn are secured to plate 79 by screws 84.

In order to cause pressure to be applied to fastener 11 and leaf 12 to effect bonding, the following linkage is employed. An elongated link 85 in the nature of a turnbuckle having screw members 86 and 87 at its opposite ends has a lower spherical bearing portion 88 mounted on crankpin 73 and an upper spherical bearing portion 89 mounted on pin 90 (FIG. 8) which also constitutes the pin connection between links 92 and 93 of toggle linkage 91. Link 85 extends through an opening 88 in beam 27. Link 93 includes a pair of spaced arms 94 (FIG. 8) and link 92 includes a pair of spaced arms 95 which fit within spaced arms 94. Set screws 96 secure pin 90 in position. The end of link 93 remote from pin 90 includes an end portion 97 which is spaced between ears 99 of standard 100 which is secured to beam 27 by means of screw 101. A pin 102 is secured within end 97 by set screws 103 and the ends of pin 102 are received in bearings 104 in ears 99. Link 92 includes a pair of ears 105 (FIG. 7) which receive end portion 106 of presser member 107, the lower end 109 of which is located between ears 110 of standard 111 which is secured to beam 27 by screw 112. A pin 113 pivotally mounts end 109 between ears 110, with pin 109 being supported by bearings 114. A set screw 115 secures pin 113 to end 109. A pin 116 extends through aligned bore 117 in end 106 and aligned bearings in ears 105. A ball detent 120 is received in groove 121 in pin 116 to hold pin 116 in position. Pin 116 can be selectively withdrawn by merely pulling on knob 122.

Presser member 107 includes an upright portion 123 between pins 113 and 116 and a cantilevered portion 124 rigidly affixed to portion 123. A presser block 125 (FIGS. 2, 3 and 5) includes spaced portions 126 lying on opposite sides of member 124. A pin 127 is secured in member 124 by set screw 129. The opposite ends 130 of pin 127 are received in oversized bores 131 of member 125. The oversized bores comprise a lost-motion connection which permits member 125 to adjust itself squarely on the leaf which it presses. A rubber pad 132 is held in member 125 by means of roll pin 133, and the downward force which member 125 applies to the fastener and leaf is the result of shaft 127 pressing downwardly through rubber pad 132.

Figure 3:
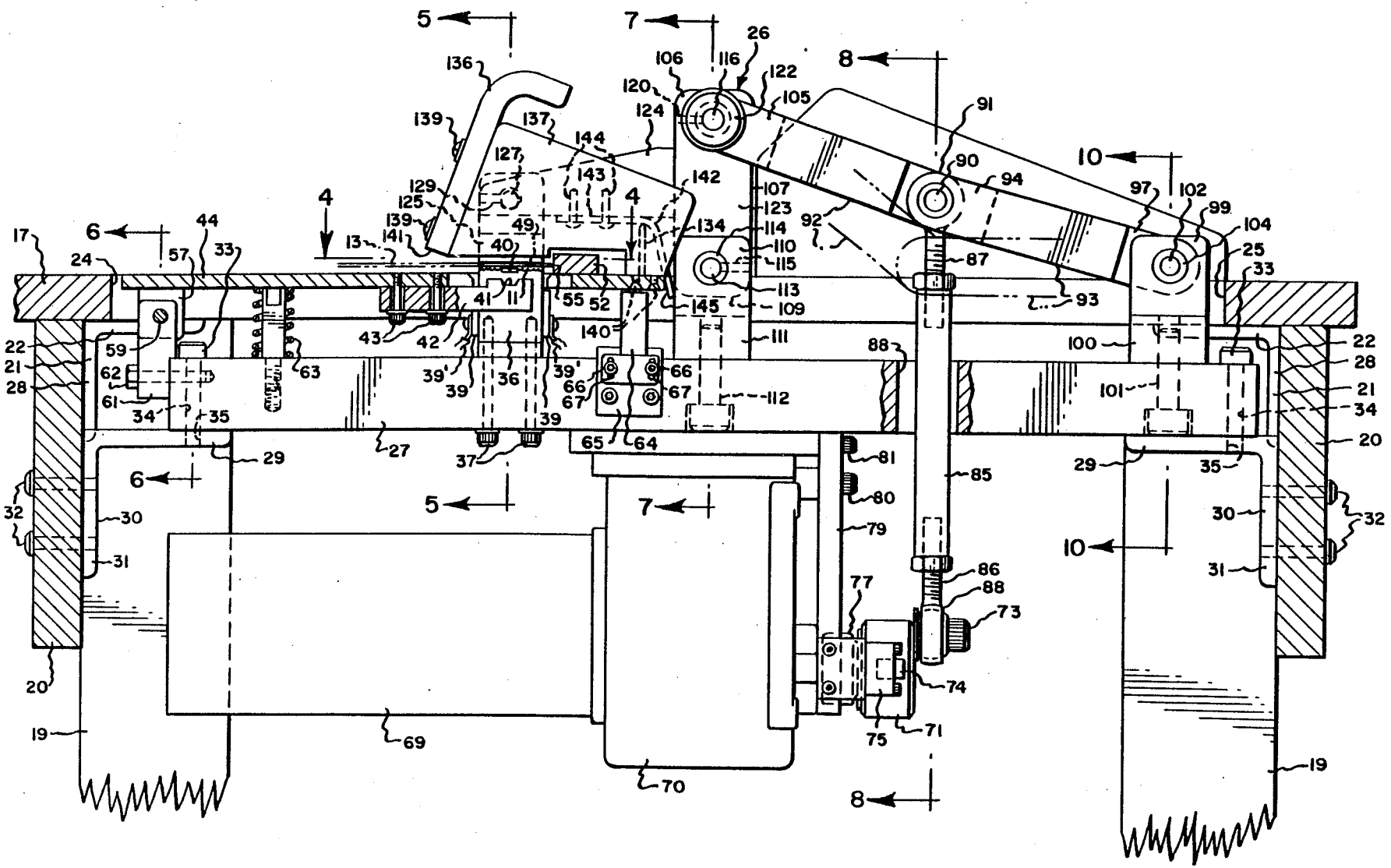
FIG. 3 is a fragmentary cross sectional view taken substantially along line 3—3 of FIG. 1.
Figure 4:
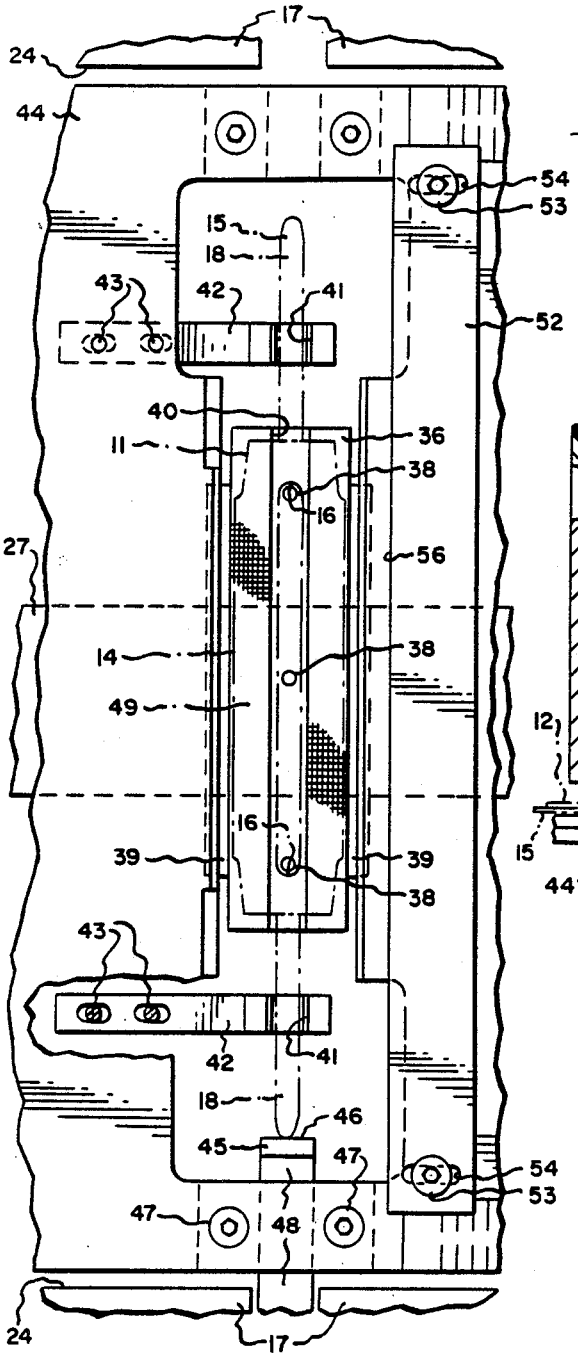
FIG. 4 is a fragmentary view taken substantially along line 4—4 of FIG. 3 and showing a fastener located in the machine for subsequent attachment to the leaf of a file folder.

From the foregoing it can be seen that when crank pin 73 is in a bottom dead center position in FIGS. 3 and 8, the toggle linkage 92-93 will be in the dotted line position of FIG. 3 which in turn will have caused presser member 107 to have pivoted in a clockwise direction about pin 113 which thus opens a gap between pressing element 125 and platen 36 to permit insertion of a fastener 11 in the manner described above and which also provides the necessary clearance for inserting the folder leaf 12. When the plate 44 is depressed to actuate the bonding cycle, the movement of crank pin 73 to the top dead center position will cause the toggle linkage 92-93 to assume the solid line position shown in FIG. 3 which causes pressing element 125 to press the fastener and leaf together between it and platen 36.

In order to insure that spring 63 (FIG. 3) which pivots plate 44 upwardly does not move such plate too close to presser element 125, a lug 134 is affixed to the upper surface of plate 44, and the upper surface of lug 134 can abut the undersurface of member 124 and when it does, the two cannot approach each other further because lug 134 defines the minimum distance therebetween.

Figure 1:
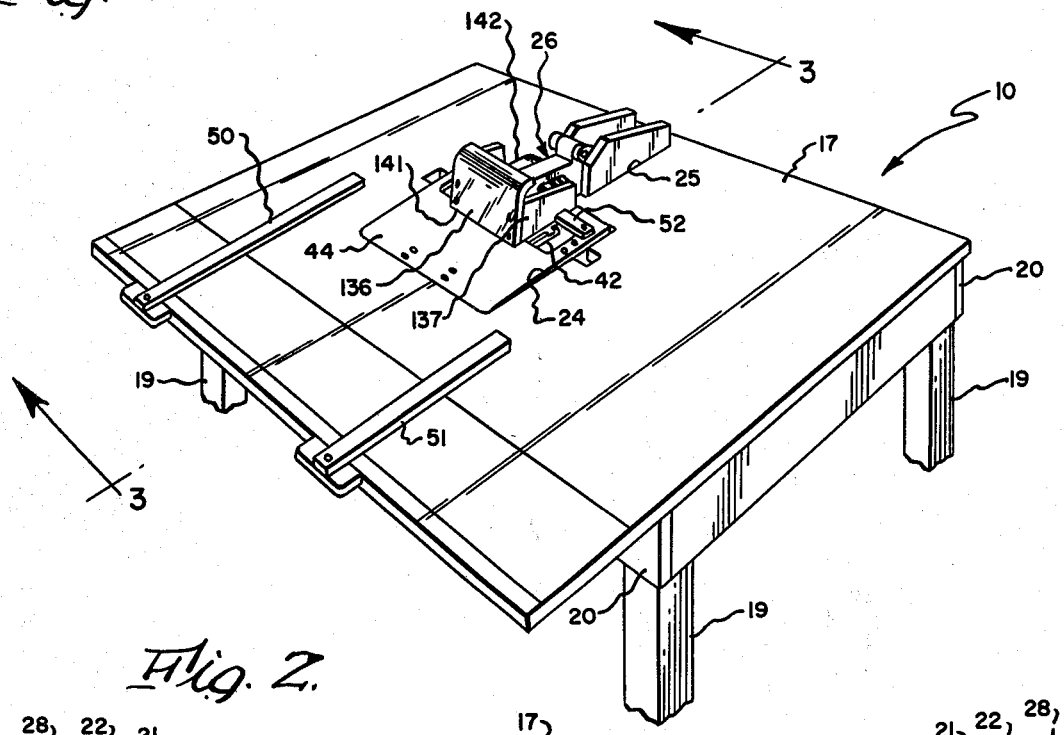
FIG. 1 is a fragmentary perspective view of the fastener bonding machine of the present invention.
Figure 2:
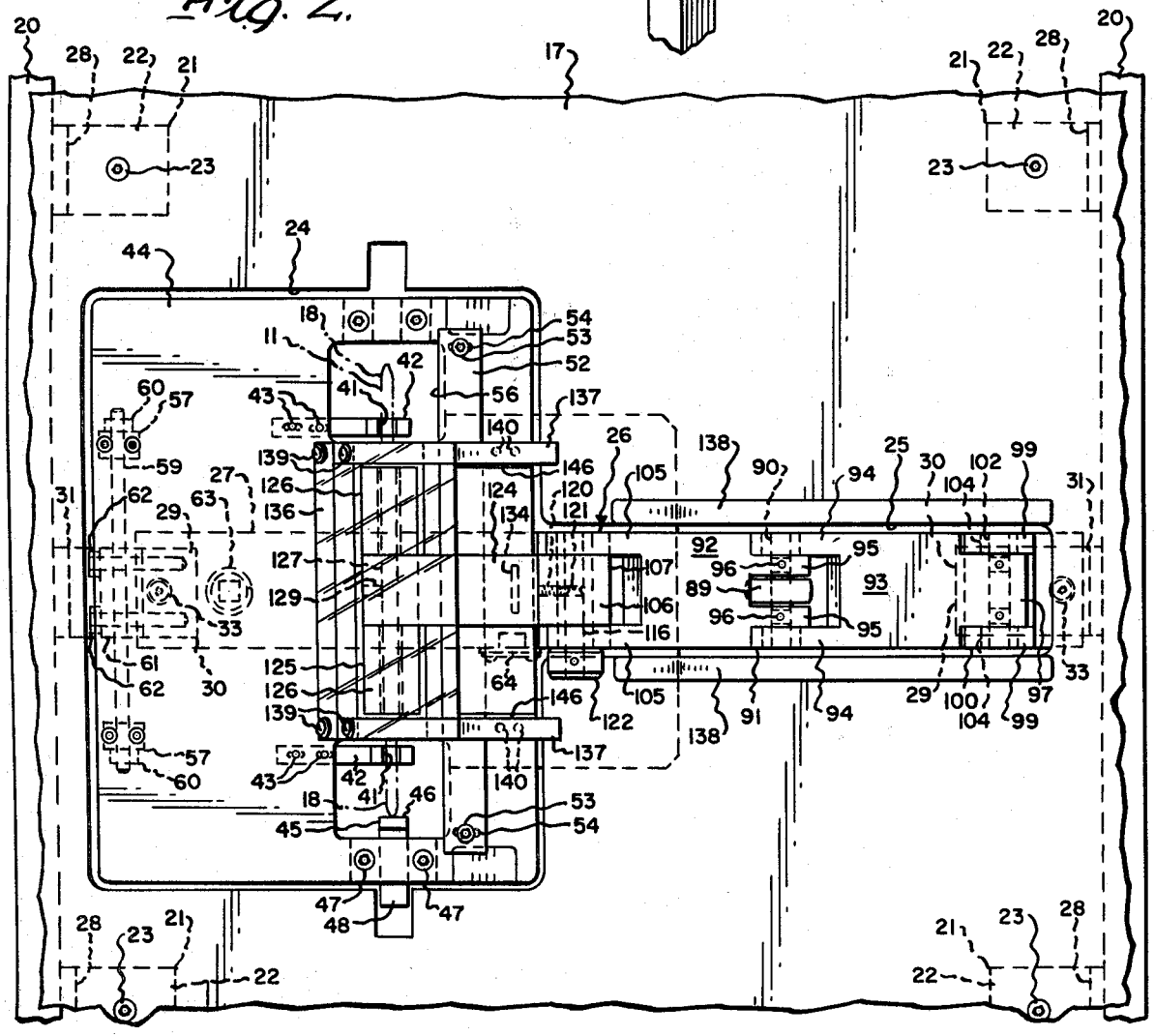
FIG. 2 is a fragmentary plan view of the fastener bonding machine.

Safety guards are provided for preventing an operator from getting his fingers between moving parts. A transparent face plate 136 is attached to side plates 137 by means of screws 139. Side plates 137, in turn, are attached to plate 44 by screws 140. The space between the lower edge 141 of guard 136 and the upper surface of plate 44 is such that an operator cannot get his fingers between the two or between the lower sides of plates 137 and the top of plate 44. Therefore, the operator cannot move his fingers between the presser element and the platen, or between any other moving parts. In addition to the foregoing, a guard 142 (FIG. 3) has its horizontal portion 143 secured to the underside of member 124 by means of screws 144 and the depending portion 145, which extends rearwardly from portion 143, is located as shown in FIG. 3 to prevent an operator from placing his fingers into the mechanism obstructed by guard 142. Guard 142 extends practically the full distance between sides 137 but there is a clearance at 146 (FIG. 2). In addition, side plates 138 are guards to prevent fingers on other foreign objects from entering the linkage obstructed thereby from a lateral direction.

In the event access is required to the various parts of machine portion 26, it is only necessary to remove pin 116 (FIG. 7) from between link 92 and presser member 107. Thereafter, link 92 can be pivoted in a clockwise direction about pin 90 and presser member 107 can be pivoted in a clockwise direction about pin 113 so that it no longer overlies plate 44. Thereafter, plate 44 may be pivoted in a counterclockwise direction about pin 59. As can be seen, all of the parts under plate 44 will now be exposed for servicing or adjustment, as may be required. In the event that it is required to service the entire machine assembly 26, all that is necessary is to remove two screws 33 and lift the entire unit out of its associated table.

Figure 11:
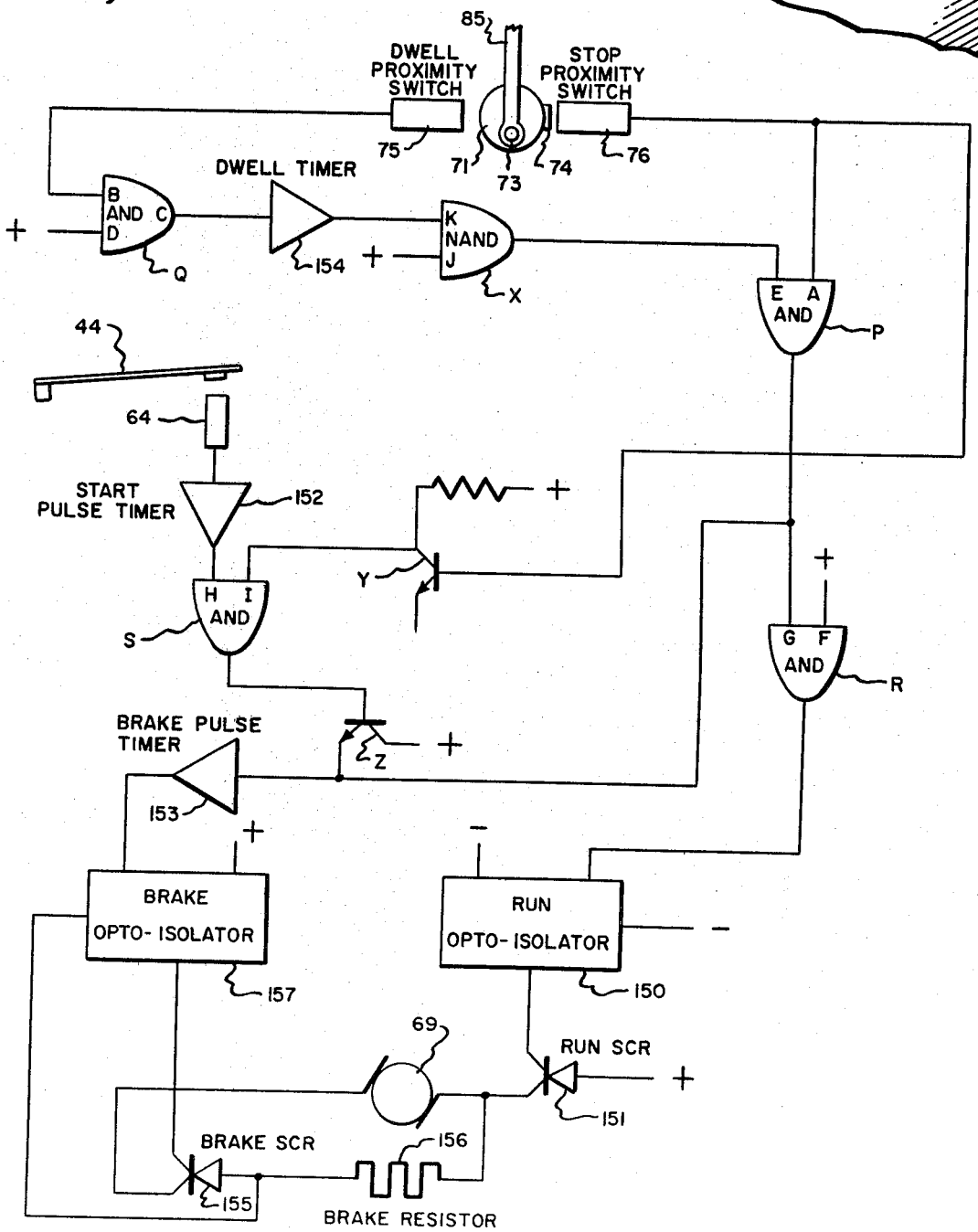
FIG. 11 is a schematic diagram of the control circuit for governing operation of the machine.

The control circuit for governing operation of the machine is shown in the schematic diagram of FIG. 11. When the machine is at rest with presser member 125 away from platen 36, lug 74 on crank 71 will be adjacent the stop proximity switch 76. The input A of AND gate P is low. The input B of AND gate Q is high because of the absence of lug 74 next to dwell proximity switch 75. Therefore, the output C of gate Q is high because terminal D is high. This being the case, the output of NAND gate X is high and this high output is connected to terminal E of AND gate P. Because input E of gate P is high, while the other input A is low, the output of gate P is low. Input F of AND gate R is always high. However, with input G low and input F high, the output of AND gate R connected to the input of the run opto-isolator 150 is low. Therefore, the run SCR 151 will not permit the flow of current to motor 69 and it will be at rest.

When plate 44 is depressed to initiate a bonding operation, it will approach proximity switch 64 and this will cause start proximity switch 64 to switch to low and thus cause pulse time 152 to generate a high pulse of about 1 second at input H of AND gate S. Input I of AND gate S is high because transitor Y is turned off. Since both inputs of AND gate S are high, its output is also high. This turns on transistor Z, making its emitter the input of the braking time 153, and the input G of AND gate R will become high. Since the input F of gate R is always high, its output is now high. This turns on the run opto-isolator which in turn gates the run SCR 151 to start the motor, and the motor will continue to run until the run SCR is turned off by the output of gate R becoming low.

The start pulse generated by start proximity switch 64 lasts sufficiently long to allow lug 74 of crank 71 to move away from stop proximity switch 76, thus making the input A of AND gate P high. Since input E of AND gate P is already high, the output of AND gate P and the input G of AND gate R and the input of the brake pulse timer 153 are held high, and the motor 69 continues to run so as to move the presser member 125 onto a fastener held on the platen 36. When the lug 74 approaches dwell proximity switch 75, the presser member 125 is in its approximately fully lowered position. Thus, the output of proximity switch 75 will now be switched to low, and this will turn off the AND gate Q, making its output low. This causes the dwell timer 154 to generate a high pulse of approximately 1 second duration. With both inputs J and K to NAND gate X high, the output becomes low and this turns off AND gate R because AND gate P is also turned off. When AND gate R turns off, the run SCR 151 also shuts off. Simultaneously, the input to the braking timer 153 becomes low which causes this timer to generate a braking pulse of approximately 0.1 seconds. This gates the braking SCR 155 through the brake opto-isolator 157 and provides a path for current to flow through the braking resistor 156 to effect dynamic braking of motor 69. This current continues to flow until the motor comes to a complete stop.

At the end of the dwell period, the motor 69 restarts and runs until the lug 74 inactivates the stop proximity switch 76, and when the leading edge of lug 74 reaches the stop proximity switch 76, the output switches to low. This turns off AND gate P and the run SCR 151. At the same time a pulse is generated by the brake pulse timer 153 for applying dynamic braking, as described above. When the motor 69 stops about ½ second after dynamic braking starts, the control circuit causes the presser member 125 to be in its uppermost position and at rest until a new cycle is again initiated by the movement of plate 44 toward stop proximity switch 64.

It can thus be seen that the improved fastener bonding machine of the present invention is manifestly capable of achieving the above enumerated objects, and while preferred embodiments of the present invention have been disclosed, it will be appreciated that the present invention is not limited thereto but may be otherwise embodied within the scope of the following claims.

What is claimed is:

1. A fastener bonding machine comprising a base, a heatable platen on said base, means for heating said platen, first gauge means on said base for orienting a fastener having a pronged member and an overlay member with adhesive thereon in contiguous relationship to said platen, leaf-receiving means including second gauge means on said base for receiving a leaf to which said fastener is to be bonded with said leaf being oriented in overlying relationship to said fastener, a presser member for pressing said leaf toward said platen with said fastener therebetween, a motor, a toggle linkage between said motor and said presser member, means for energizing said motor to move said toggle linkage from a relatively nonaligned position to a relatively aligned position to cause said presser member to approach said platen to press said leaf and fastener together while said fastener is being heated by said platen and to thereafter cause said toggle linkage to return to said relatively nonaligned position to permit removal of said leaf after said fastener has been adhesively secured thereto, a crank on said motor, a link between said crank and said toggle linkage whereby rotation of said crank actuates said toggle linkage, switch means for energizing said motor, and control means for causing said motor to move said crank through a cycle from a first position where said toggle linkage causes said presser member to be away from said platen to a second position wherein said presser member is adjacent said platen and dwells in said second position and back to said first position where it stops, said leaf-receiving means comprising a pivotable plate, and spring means for normally biasing said pivotable plate away from said platen.

2. A fastener bonding machine as set forth in claim 1 including resilient means in said presser member to limit the amount of force exerted thereby.

3. A fastener bonding machine as set forth in claim 1 including means for actuating said switch means in response to movement of said plate toward said platen.

4. A fastener bonding machine as set forth in claim 3 wherein said switch means is a proximity switch.

5. A fastener bonding machine as set forth in claim 1 wherein said toggle linkage comprises first and second links with a first pivotal connection therebetween, a first standard on said base, a second pivotal connection between said first link and said first standard, a second standard on said base, a third pivotal connection between said second standard and said presser member, and a fourth pivotal connection between said second link and said presser member.

6. A fastener bonding machine comprising a base, a heatable platen on said base, means for heating said platen, first gauge means for orienting a pronged fastener member relative to said platen, leaf-receiving means including second gauge means for orienting a leaf to which said fastener member is to be bonded in overlying relationship to said fastener member, a motor, linkage means coupled to said motor, a presser member coupled to said linkage means to press said fastener member and said leaf toward said platen when said motor actuates said linkage means, said leaf-receiving means comprising a plate having a first end proximate said platen and a second end remote from said platen, and means for pivotally mounting said second end on said base.

7. A fastener bonding machine as set forth in claim 6 wherein said linkage means comprises a toggle linkage comprising first and second links with a pivotal connection therebetween, and a third link between said motor and said pivotal connection for moving said toggle linkage from a relatively nonaligned position to a relatively aligned position when said motor actuates said toggle linkage.

8. A fastener bonding machine as set forth in claim 7 including switch means for energizing said motor, and control means for causing said motor to move said crank through a cycle from a first position where said toggle linkage causes said presser member to be away from said platen to a second position wherein said pressure member is adjacent said platen and dwells in said second position and back to said first position where it stops.

9. A fastener bonding machine as set forth in claim 6 wherein said linkage means includes a toggle linkage having first and second links, a first pivotal connection between first ends of said first and second links, a first standard on said base, a second pivotal connection between said standard and said second end of said first link, a second standard on said base, a third pivotal connection between said second standard and said presser member, and a fourth pivotal connection between said presser member and said second end of said second link, a crankarm coupled to said motor, and an elongated link coupled between said crankarm and said first pivotal connection.

10. A fastener bonding machine as set forth in claim 9 wherein said elongated link includes first and second ends, a first spherical bearing connection between said first end of said elongated link and said crankarm, and a second spherical bearing connection between said second end of said elongated link and said first pivotal connection.

11. A fastener bonding machine as set forth in claim 9 wherein said fourth pivotal connection includes a selectively removable pin.

12. A fastener bonding machine as set forth in claim 9 including a presser block, and a lost-motion connection between said presser block and the remainder of said presser member.

13. A fastener bonding machine as set forth in claim 6 including table means, and means for removably mounting said base on said table means.

14. A fastener bonding machine as set forth in claim 13 wherein said base comprises an elongated beam.

15. A fastener bonding machine as set forth in claim 13 wherein said table means includes a top, an opening in said top, and wherein the upper portion of said fastener bonding machine extends through said opening above said table top.

16. A fastener bonding machine as set forth in claim 15 including guard means for permitting only small clearances between said top and said presser member.

17. A fastener bonding machine as set forth in claim 6 including spring means for biasing said first end of said plate away from said platen.

18. A fastener bonding machine comprising a base, a heatable platen on said base, means for heating said platen, first gauge means for orienting a pronged fastener member relative to said platen, leaf-receiving means including second gauge means for orienting a leaf to which said fastener member is to be bonded in overlying relationship to said fastener member, a motor, linkage means coupled to said motor, and a presser member coupled to said linkage means to press said fastener member and said leaf toward said platen when said motor actuates said linkage means, said leaf-receiving means comprising a plate having a first portion proximate said platen and a second portion remote from said platen, and mounting means for mounting said plate for movement toward and away from said platen.

19. A fastener bonding machine comprising a base, a heatable platen on said base, means for heating said platen, first gauge means on said base for orienting a fastener having a pronged member and an overlay member with adhesive thereon in contiguous relationship to said platen, leaf-receiving means including second gauge means on said base for receiving a leaf to which said fastener is to be bonded with said leaf being oriented in overlying relationship to said fastener, a presser member for pressing said leaf toward said platen with said fastener therebetween, a motor, a toggle linkage between said motor and said presser member, and means for energizing said motor to move said toggle linkage from a relatively nonaligned position to a relatively aligned position to cause said presser member to approach said platen to press said leaf and fastener together while said fastener is being heated by said platen and to thereafter cause said toggle linkage to return to said relatively nonaligned position to permit removal of said leaf after said fastener has been adhesively secured thereto, said toggle linkage comprising first and second links with a first pivotal connection therebetween, a first standard on said base, a second pivotal connection between said first link and said first standard, a second standard on said base, a third pivotal connection between said second standard and said presser member, and a fourth pivotal connection between said second link and said presser member.

20. A fastener bonding machine as set forth in claim 19 wherein said fourth pivotal connection includes a selectively removable pin.

* * * * *